US009579925B1

(12) United States Patent
Cooper

(10) Patent No.: US 9,579,925 B1
(45) Date of Patent: Feb. 28, 2017

(54) PAINT ROLLER HOOK

(71) Applicant: Greg Cooper, Jacksonville, FL (US)

(72) Inventor: Greg Cooper, Jacksonville, FL (US)

( * ) Notice: Subject to any disclaimer, the term of this patent is extended or adjusted under 35 U.S.C. 154(b) by 70 days.

(21) Appl. No.: 14/587,052

(22) Filed: Dec. 31, 2014

(51) Int. Cl.
*B44D 3/12* (2006.01)
*B05C 17/02* (2006.01)

(52) U.S. Cl.
CPC ..... *B44D 3/123* (2013.01); *B05C 17/0245* (2013.01)

(58) Field of Classification Search
CPC ..... A47B 81/02; A46B 17/02; A46B 17/00; A46B 5/00; A47K 1/09; B44D 3/123; B44D 3/12; B65C 17/0205; B25G 1/08; B25G 3/00; A47L 13/512
USPC ..... 248/351, 110, 111, 113; 15/145, 146
See application file for complete search history.

(56) References Cited

U.S. PATENT DOCUMENTS 1,005,985 A * 10/1911 Lebherz ..... A47K 1/09 132/308
1,053,523 A * 2/1913 McMillian ..... B65H 49/08 132/308
1,313,515 A * 8/1919 Caffrey ..... B44D 3/123 248/692
2,034,494 A * 3/1936 Stoll ..... F16B 39/24 411/147
3,275,187 A * 9/1966 Lamoureaux ..... B44D 3/123 15/105
3,891,175 A * 6/1975 Hawley et al. ..... G08G 1/095 248/317
4,025,205 A * 5/1977 Hawk ..... B44D 3/126 15/230.11
4,364,143 A * 12/1982 Uhl ..... A46B 5/00 15/145
4,525,889 A * 7/1985 Dunau ..... A46B 17/02 15/143.1
4,835,812 A * 6/1989 Su ..... B05C 17/02 15/105
4,905,951 A * 3/1990 Putness ..... A47L 13/512 211/66
5,033,155 A * 7/1991 Klotz ..... A46B 7/00 15/144.4
5,398,365 A * 3/1995 MacKenzie ..... A46B 11/063 15/160
6,871,825 B2 * 3/2005 Song ..... B44D 3/123 248/110
8,236,006 B2 * 8/2012 Hamada ..... A61B 17/7001 606/104
8,371,549 B1 * 2/2013 Paquette ..... A47K 1/09 211/66
8,387,198 B2 * 3/2013 Rodriguez ..... B25G 1/04 15/144.3
8,596,597 B1 12/2013 Spicer
8,839,480 B2 * 9/2014 Thomas ..... B25G 1/00 15/143.1

(Continued)

*Primary Examiner* — Nkeisha Smith
(74) *Attorney, Agent, or Firm* — Lawrence J. Gibney; Mitchell R. Ghaneie

(57) ABSTRACT

This device is comprised of a washer with one or two hooks on either side of the washer. The washer may also have serrated surfaces to prevent an extension pole and a handle of a paint roller frame from untightening during normal painting operation. The hook(s) allow the paint roller and extension pole to be hung on the lip of a paint bucket or other container so that the roller does not dry out during the painting operation.

5 Claims, 3 Drawing Sheets

(56) References Cited

U.S. PATENT DOCUMENTS

| | | | | |
|---|---|---|---|---|
| 2003/0180085 | A1* | 9/2003 | Hughes | A01B 1/227<br>401/289 |
| 2004/0083579 | A1* | 5/2004 | Furr-Britt | A47L 9/325<br>16/421 |
| 2007/0158518 | A1* | 7/2007 | Kurdoghlian | A47K 1/09<br>248/312 |
| 2008/0142648 | A1* | 6/2008 | Rabi | A46B 5/0033<br>248/113 |
| 2009/0187194 | A1* | 7/2009 | Hamada | A61B 17/7001<br>606/104 |
| 2012/0298135 | A1* | 11/2012 | Luttrell | A46B 17/02<br>134/6 |

* cited by examiner

PAINT ROLLER HOOK

BACKGROUND OF THE INVENTION

A. Field of the Invention

This invention relates to providing painters with an option of hanging a paint roller on the edge of an bucket and keeping an extension pole tightly fastened to the handle of a paint roller frame. This allows the roller to be submerged in the paint to prevent drying the roller out. The device was originally contemplated to be used in connection with a paint roller and extension pole, but may also be used with other paint applicators.

B. Prior Art

Paint rollers and extension poles for painting have been available to painters for quite some time. However, some common problems associated with using a paint roller attached to an extension pole is having no place to set it down without having to disconnect the roller frame from the extension pole, creating a tripping hazard by placing the roller on a paint bucket or paint tray and laying the pole on the ground, or consistently having to tight the two objects together due to coming undone while being used.

BRIEF SUMMARY OF THE INVENTION

Usually when a painter wants to attach a paint roller frame to an extension pole, the painter will twist the exterior threads of the extension pole into the interior thread of the paint roller frame handle as tightly as possible. However, after an extended period of time the paint roller frame untightens and comes loose from the extension pole. Consequently, the painter must stop painting and tighten the handle and extension pole back together. In addition to the delay that is caused, the act of tightening is also frequently messy.

This device is comprised of a split lock washer, which has two hooks on either side to aid in the use of a paint roller that is attached to an extension pole. Other types of washers may be used but it is contemplated that regardless of the type of washer one or two hooks will be on the side of the washer.

The exterior threads of the extension pole would fit through the split lock washer and then into the handle of the paint roller frame; the paint roller fits on the paint roller frame. The split lock washer would provide tension between the handle and the pole, which would prevent the two sections from coming loose. Accordingly, painters can spend less time adjusting the two tools and more time painting.

After the extension pole and handle are tightened together the hooks that are formed as part of the split lock washer may be used to support the pole and paint frame on the lip of a bucket by inverting the pain roller. This device allows the painter to submerge the brush or roller, if desired, in the paint to prevent the roller from drying out.

It is also contemplated that one hook may be utilized rather than two hooks. It is also contemplated that a different washer may be used to lock the extension pole and handle together.

NUMBERING REFERENCE

5 Device
10 Split Lock Washer
15 Hook
20 Extension Pole
21 Exterior Threads of Extension Pole
25 Paint Roller Frame Handle
26 Interior Threads of Paint Roller Frame Handle
30 Paint Bucket Screen
35 Paint Bucket

DETAILED DESCRIPTION OF THE EMBODIMENTS

This device 5 is intended to increase job site safety and improve employee efficiency. Although this device is described as being used with a paint frame handle and an extension pole, it is contemplated that it may also be used with other paint applicators.

This device is comprised of a washer 10 such as a split lock washer as depicted and described for purposes of this application although other types of washers may be used and two hooks 15 that are formed together as part of the device; the two hooks extend a predetermined distance away from the washer directly opposed to each other. It is contemplated that an alternative embodiment could include only one hook 15, which would be attached to the split lock washer 10, with one or more serrated surfaces for additional gripping surface.

Figure 1:
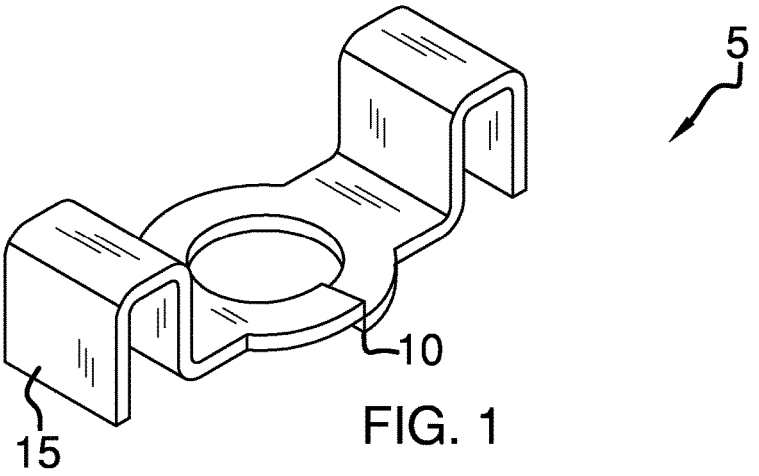
FIG. 1 is an isometric view of the device.
Figure 2:
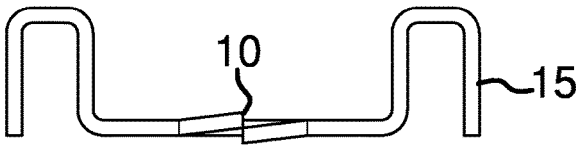
FIG. 2 is a front view of the device.
Figure 3:
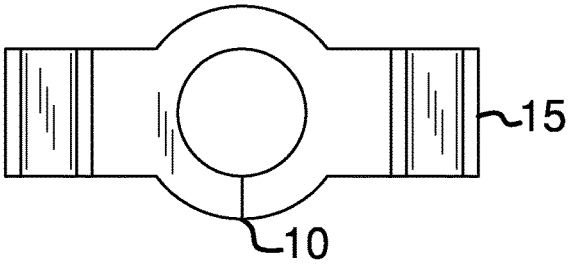
FIG. 3 is a bottom view of the device.
Figure 4:
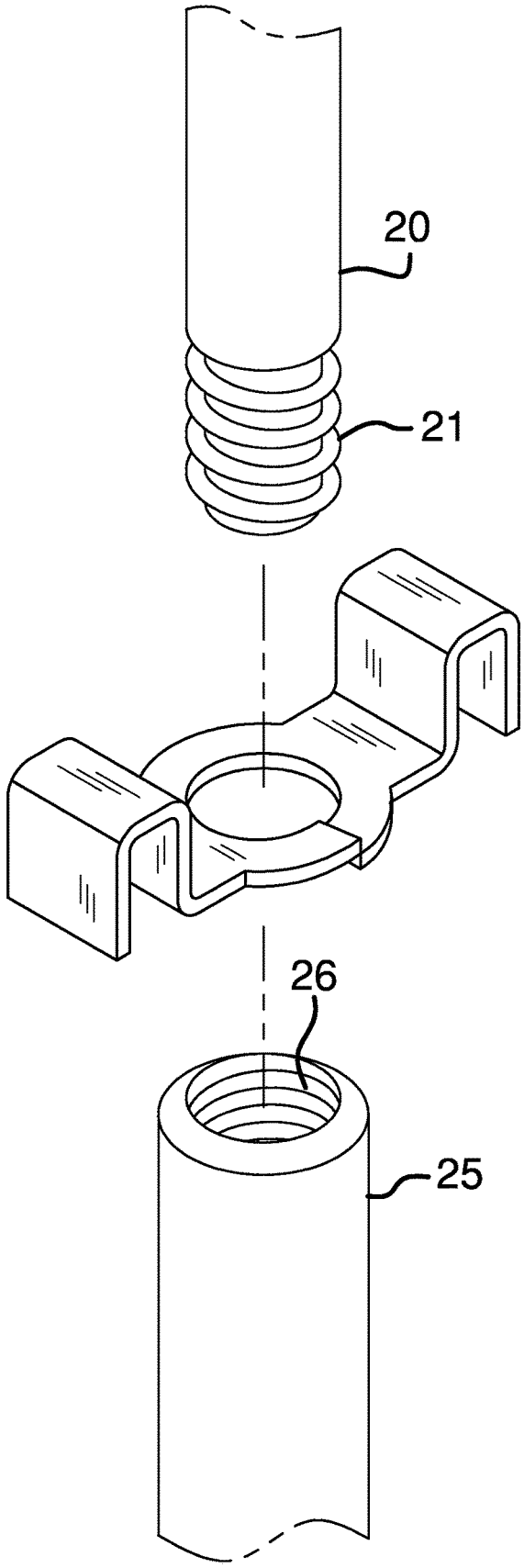
FIG. 4 is an isometric view depicting how the exterior threads of an extension pole fit through the device and into the interior threads of the handle of a paint roller frame.

A flat washer with serrated surfaces may also be used because the serrated surface provides a means to grip the respective extension pole and pain roller frame. As shown in FIG. 4, the washer 10 is placed over the exterior threads of the extension pole 21. The exterior threads are then twisted into the interior threads of the paint roller frame handle 26, thereby causing the device to be located between the extension pole 20 and the handle 25 during normal use.

Figure 5:
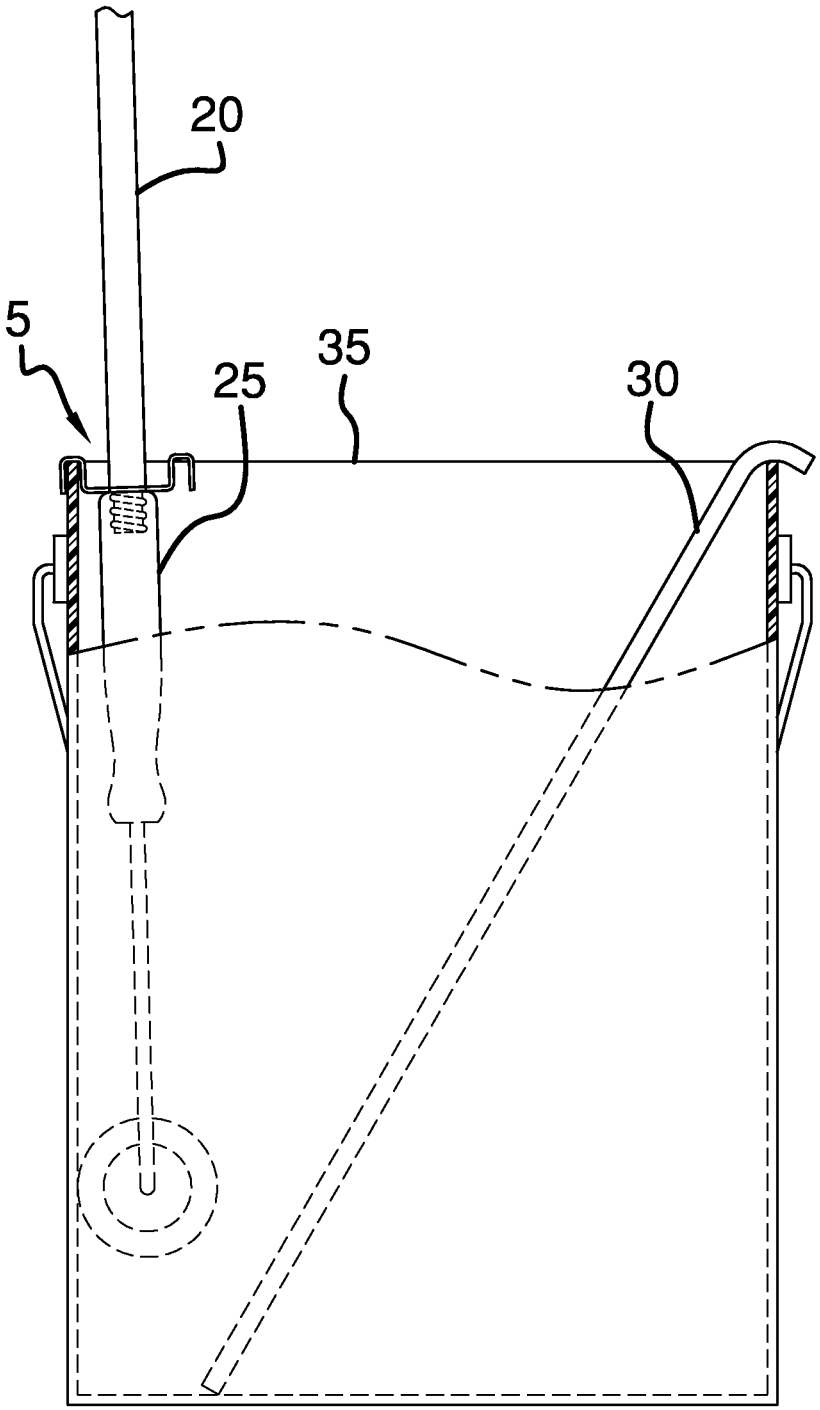
FIG. 5 is a side view depicting how the device may be used with a paint bucket filled with paint.

The split lock washer 10 would provide pressure between the pole 20 and the handle 25 so that the two sections (extension pole and paint roller frame) do not come loose while being used. The device will not interfere with the normal painting operation. The hooks 15 would allow the extension pole and paint roller frame to hang on the lip of a paint bucket 35 as shown in FIG. 5, by inverting the paint roller and placing the roller in the bucket. This prevents the extension pole from having to lay on the ground and would be clearly visible so that it is not a tripping hazard and not otherwise an obstacle to other painters. In addition, the device allows the paint roller to be submerged (partially or full) in the wet paint, thereby preventing the paint on the paint roller from drying.

FIG. 5 depicts the actual device in use with the roller submerged in the paint in a paint bucket. A paint screen 30 is often used and this is shown to illustrate the common means to paint.

While the embodiments of the invention have been disclosed, certain modifications may be made by those skilled in the art to modify the invention without departing from the spirit of the invention.

The inventor claims:

1. A paint roller hook that is used with an extension pole and paint roller frame comprised of:

a. a washer;

wherein the washer is of a predetermined shape;
wherein the washer has a predetermined diameter;
wherein the washer has a surface;
wherein the diameter of the washer is larger than an extension pole's exterior threads;
wherein the extension pole's exterior threads fit through the washer connecting to interior threads of the paint roller frame;

b. a hook;
wherein the hook is of a predetermined shape;
wherein the hook is formed as a part of the washer;
wherein said hook extends from a side of the washer a pre-determined length;
wherein said hook has an inverted U-shape.

2. The paint roller hook as described in claim 1 wherein a surface of the washer is serrated.

3. A paint roller hook that is used with an extension pole and paint roller frame comprised of:

a. a washer;
wherein the washer is of a predetermined shape;
wherein the washer has a predetermined diameter;
wherein the washer has a surface;
wherein the diameter of the washer is larger than an extension pole's exterior threads;
wherein the extension pole's exterior threads fit through the washer connecting to interior threads of the paint roller frame;

b. two hooks;
wherein the two hooks are of a predetermined shape;
wherein the two hooks are formed as part of the washer;
said two hooks extend from a side of the washer a pre-determined length;
wherein each of the two hooks are geometrically opposed to each other on the sides of the washer;
wherein each of the two hooks has an inverted U-shape.

4. The paint roller hook as described in claim 3 wherein a surface of the washer is serrated.

5. A method to use the paint roller hook as described in claim 1, which is comprised of the following steps:

a. placing the washer of the paint roller hook over a plurality of exterior threads of the extension pole;
b. attaching the exterior threads of the extension pole to a plurality of interior threads of a paint roller frame handle of the paint roller frame;
c. securing the extension pole to the paint roller frame handle;
d. tightening the extension pole to the paint roller frame handle;
e. hanging the paint roller hook over an edge of a paint bucket;
f. allowing the paint roller frame and extension pole to hang inverted.

* * * * *